US006905394B2

(12) United States Patent
Sudo et al.

(10) Patent No.: US 6,905,394 B2
(45) Date of Patent: Jun. 14, 2005

(54) APPARATUS AND METHOD FOR POLISHING ROW BARS

(75) Inventors: Koji Sudo, Kawasaki (JP); Yoshiaki Yanagida, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/782,820

(22) Filed: Feb. 23, 2004

(65) Prior Publication Data

US 2005/0064793 A1 Mar. 24, 2005

(30) Foreign Application Priority Data

Sep. 18, 2003 (JP) ..... 2003-326656

(51) Int. Cl.[7] ..... B24B 49/00
(52) U.S. Cl. ..... 451/24; 451/5; 451/8
(58) Field of Search ..... 451/24, 5, 8, 10, 451/11, 57, 259, 287

(56) References Cited

U.S. PATENT DOCUMENTS 6,315,636 B1 * 11/2001 Yanagida et al. ..... 451/11
6,375,539 B1 * 4/2002 Sudo et al. ..... 451/5
6,443,813 B1 * 9/2002 Strom et al. ..... 451/41
6,722,947 B2 * 4/2004 Nishioka et al. ..... 451/10

FOREIGN PATENT DOCUMENTS

JP 2002-157723 5/2002

* cited by examiner

*Primary Examiner*—Joseph J. Hail, III
*Assistant Examiner*—Alvin J Grant
(74) *Attorney, Agent, or Firm*—Armstrong, Kratz, Quintos, Hanson, & Brooks, LLP.

(57) ABSTRACT

An apparatus and a method for polishing a row bar including magnetic head sliders. A lapping surface plate is rotatable, and a housing is movable above the lapping surface plate. A jig is secured to the housing for holding the row bar. The jig is formed by an elongated rigid member having a plurality of holes and an elongated elastic member fixed to the rigid member. An air cylinder presses the whole row bar, and a pressing devices individually presses portions of the elastic member corresponding to magnetic head sliders of the row bar through the holes of the rigid member. A portion of the elastic member is deformed to press a portion of the row bar in response to a change in the measured resistance of ELG resistance elements in the row bar.

17 Claims, 7 Drawing Sheets

APPARATUS AND METHOD FOR POLISHING ROW BARS

BACKGROUND OF THE INVENTION

1. Field of the Invention

The present invention relates to the production of a magnetic head sliders used in magnetic disk apparatuses. More specifically, the present invention relates to an apparatus for polishing a row bar including magnetic head sliders and to a polishing method.

2. Description of the Related Art

Magnetic head sliders used in the magnetic disk apparatuses are, first, prepared in a large number in the form of a wafer by a film forming technology. The wafer is then cut into row bars including a plurality of magnetic head sliders. The row bars are then polished so that the floating surfaces of the magnetic head sliders become smooth, and are then cut into individual magnetic head sliders.

The row bar is polished through two steps, i.e., an initial polishing (ELG polishing) and a finish polishing (touch lap polishing or crown polishing). The polishing of a row bar is disclosed in, for example, Japanese Unexamined Patent Publication (Kokai) No. 2002-157723, and U.S. Pat. No. 6,375,539. The finish polishing is conducted to release the bending stress in the row bar after the initial polishing, to further improve the smoothness of the surface and to form a crown on the surface.

In the finish polishing, for example, a lapping surface plate having a spherical surface is used, the row bar is adhered to a jig made of an elastic member, and the polishing is carry out by pressing the row bar adhered to the elastic member against the rotating lapping surface plate.

The row bar is adhered to the elastic member and the positioning of the elastic member is difficult, so laborious work is required for precisely positioning the row bar and, besides, polishing the row bar is apt to be affected by a change in the surface state of the elastic member. Besides, as the row bar is held by the elastic member, the terminals of resistance elements of the row bar cannot be bonded to the terminals of a measuring device with bonding wires, so the resistance cannot be measured in the inprocess condition and is apt to be affected by the lapping rate, giving rise to the occurrence of defects such as over-cutting.

SUMMARY OF THE INVENTION

It is, therefore, an object of the present invention to provide an apparatus and a method for polishing a row bar of magnetic head sliders, capable of controlling the pushing pressure for the individual magnetic head sliders provided in the row bar to precisely polish the row bar.

Another object of the present invention is to provide an apparatus and a method for polishing a row bar of magnetic head sliders, capable of measuring the resistance during the inprocess operation.

An apparatus for polishing a row bar including magnetic head sliders, according to the present invention, comprises: a rotatable lapping surface plate; a movable housing above the lapping surface plate; a jig secured to the housing and comprising a rigid member having a plurality of holes and an elastic member fixed to the rigid member for holding a row bar; first pressing means for applying a pressure to the whole row bar; and second pressing means for the individually pressing portions of the elastic member corresponding to a plurality of magnetic head sliders of the row bar through the holes in the rigid member.

In this constitution, the jig comprising the rigid member and the elastic member can be easily and reliably secured to the housing so that it can easily and reliably hold the row bar at a predetermined position. The row bar can be held by the elastic member, by bringing the row bar into intimate contact with the elastic member, even if the row bar is not adhered to the elastic member. The pressing force applied to the elastic member through the holes in the rigid member is transmitted to the row bar to correct the shape of the row bar.

A method of polishing a row bar including magnetic head sliders, according to the present invention, comprises the steps of: securing a jig to a movable housing, the jig including a rigid member having a plurality of holes and an elastic member fixed to the rigid member; holding a row bar by said jig; moving the housing above a lapping surface plate; turning the lapping surface plate to polish the row bar while pressing the row bar onto the lapping surface plate; measuring a changes in the resistance of resistance elements provided in the row bar; and individually pressing portions of the elastic member corresponding to a plurality of magnetic head sliders of the row bar through the holes of the rigid member in response to a change in the resistance of resistance elements provided in the row bar.

In this constitution, the jig comprising the rigid member, and the elastic member, can be easily and reliably secured to the housing and the resistance of resistance elements provided in the row bar can be measured in the inprocess condition, whereby the portions of the elastic member corresponding to the magnetic head sliders of the row bar can be individually pressed with variable forces in response to the measured value. The polishing is finished when the target resistance is reached to accomplish more precise polishing.

In lapping the magnetic head sliders, according to the present invention as described above, it is allowed to control the pressing force for each of the magnetic head sliders in the row bar, and a row bar of any shape can be corrected to be as straight as possible, making it possible to provide magnetic head sliders with good precision. In the apparatus of the static pressure type, in particular, no complex or fine mechanism is employed. Therefore, the unit is assembled through a very decreased number of steps accompanied by very decreased defects. Besides, as compressed air is directly used, dispersion is decreased in the thrust produced through the individual holes, and a highly precise control is accomplished. Besides, the resistance elements in the row bar are connected, by bonding wires, to the terminals of a relay board, to measure the resistance in the inprocess condition, which makes it possible to effect the lapping with high precision.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

The preferred embodiments of the present invention will now be described with reference to the drawings.

Figure 1:
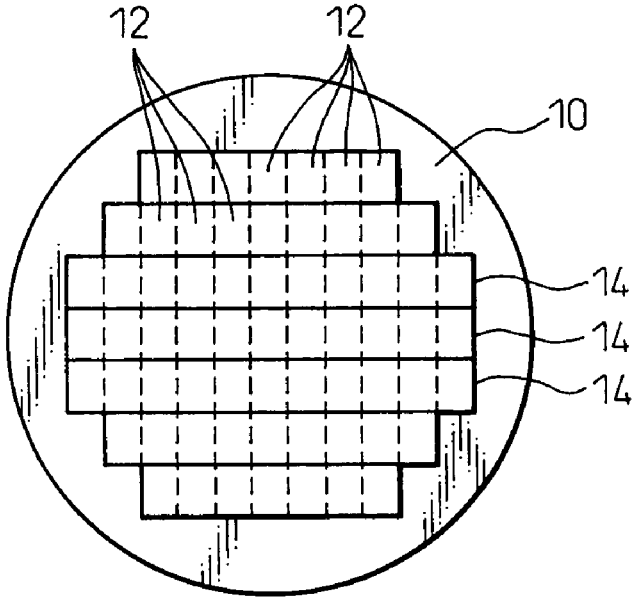
FIG. 1 is a view illustrating a wafer in which many magnetic head sliders are fabricated.
Figure 2:
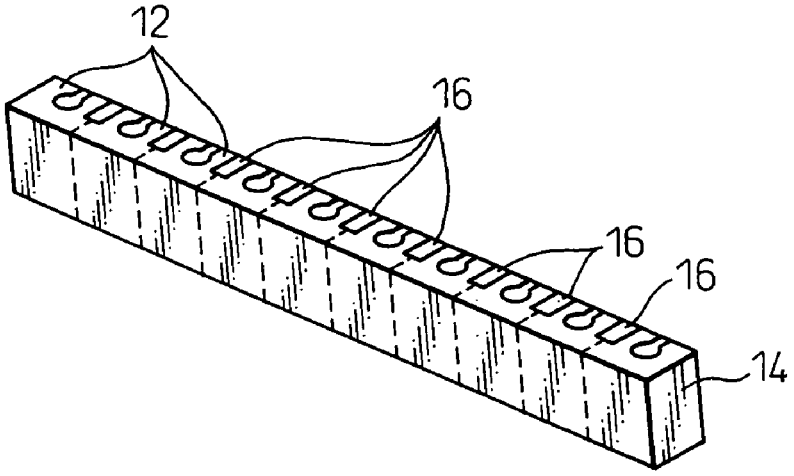
FIG. 2 is a view illustrating a row bar cut from the wafer of FIG. 1.

FIG. 1 is a view illustrating a wafer in which a number of magnetic head sliders are fabricated. The wafer 10 includes many magnetic head sliders 12 fabricated therein by known technology. FIG. 2 is a view illustrating a row bar 14 cut from the wafer 10 of FIG. 1. The row bar 14 includes a plurality of magnetic head sliders (MR heads) 12. An ELG resistance element 16 is provided in a boundary between the two magnetic head sliders 12.

The surface of the row bar 14 which serves as a floating surface is polished. The row bar 14 is polished through two steps, i.e., an initial polishing (ELG polishing) and a finish polishing (touch lap polishing or crown polishing). The present invention is related to the finish polishing of the row bar 14 after the initial polishing is carried out.

Figure 3:
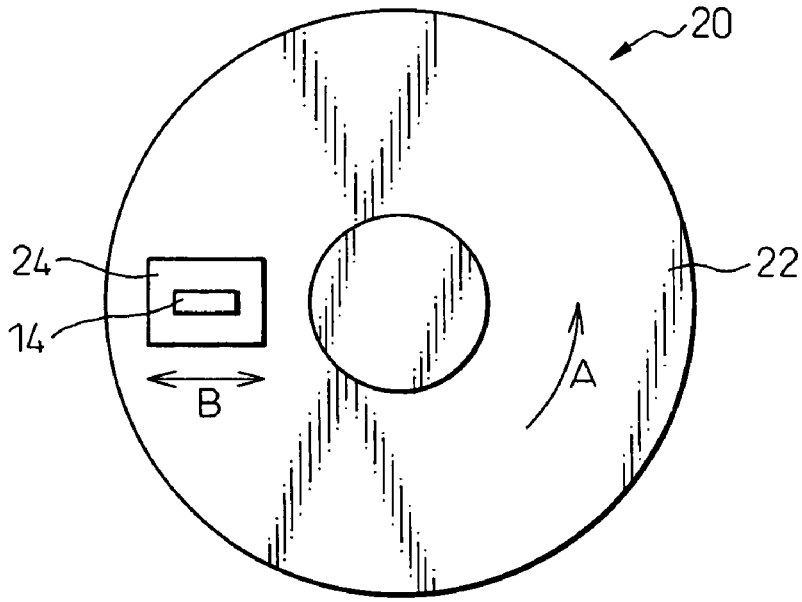
FIG. 3 is a schematic plan view illustrating a lapping surface plate, and a housing supporting the row bar, which are parts of the apparatus for polishing the row bar.

FIG. 3 is a schematic plan view illustrating a lapping surface plate 22, and a housing 24 supporting the row bar 14, which are parts of the apparatus for polishing the row bar 14 including a plurality of magnetic head sliders 12. The operation for polishing the row bar 14 is carried out by rotating the lapping surface plate 22 as indicated by the arrow A, reciprocally moving the row bar 14 in the radial direction of the lapping surface plate 22 as indicated by the arrow B, and pressing the row bar 14 onto the lapping surface plate 22. For example, the lapping surface plate 22 has a spherical surface and rotates at a speed not higher than 10 rpm and, desirably, at 1 rpm. Fine diamond abrasive particles are buried in the surface of, or in the whole of, the lapping surface plate 22.

Figure 4:
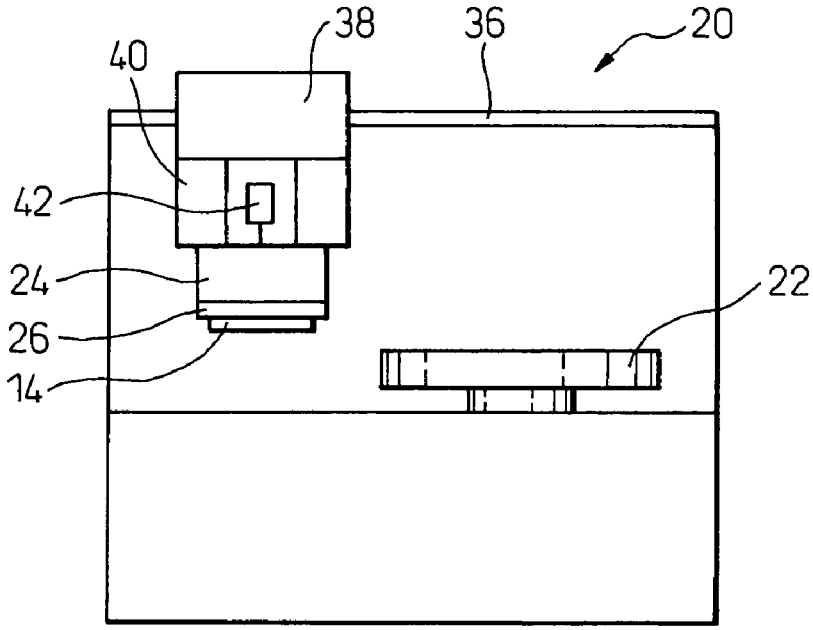
FIG. 4 is a schematic side view illustrating the polishing apparatus.
Figure 7:
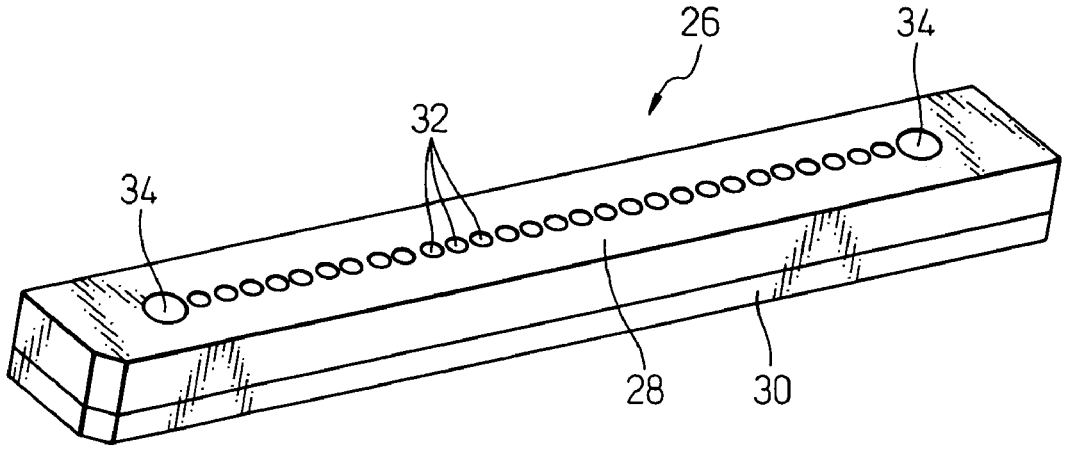
FIG. 7 is a perspective view illustrating the jig comprising a rigid member and an elastic member.

FIG. 4 is a schematic side view illustrating the polishing apparatus 20. A jig 26 is secured to the housing 24, and the row bar 14 is held by the jig 26. Referring to FIG. 7, the jig 26 comprises an elongated and straight plate-like rigid member 28 and an elongated and straight plate-like elastic member (anti-static rubber) 30 having a contour substantially the same as that of the rigid member 28 and fixed to the rigid member 28. The elastic member 30 is produced by a rubber lining manufacturing method and is joined to the rigid member 28. Typically, the elastic member 30 is joined to the rigid member 28 with an adhesive. It is desired that the rigid member 28 is made of a stainless steel and hardened so that it has a Rockwell hardness $H_{RC}$ of not smaller than 55. It is further desired that the elastic member 30 is made of an anti-static rubber (surface resistivity of $10^6$ to $10^9$ Ω·cm).

The rigid member 28 has a series of pin insertion holes (through holes) 32 corresponding to the plurality of magnetic head sliders 12 provided in the row bar 14, while the elastic member 30 does not have such holes. The rigid member 28 has jig securing threaded holes 34 on the outer sides of a series of pin insertion holes 32. Therefore, the jig 26 can be easily and reliably secured to the housing 24 by driving screws into the jig securing threaded holes 34 through corresponding holes provided in the housing 24.

In FIG. 4, the polishing apparatus 20 has a slide member 38 that can move along a horizontal guide 36, and an elevator 40 mounted on the slide member 38 so as to move in a vertical direction. The housing 24 is mounted on the elevator 40. An air cylinder 42 is arranged in the elevator 40 to press the row bar 14, held by the jig 26 secured to the housing 24, toward the lapping surface plate 22. As shown in FIG. 3, therefore, the lapping surface plate 22 rotates as indicated by the arrow A, the row bar 14 reciprocally moves in the radial direction of the lapping surface plate 22 as indicated by the arrow B, and the row bar 14 as a whole is pressed to the lapping surface plate 22.

Figure 5:
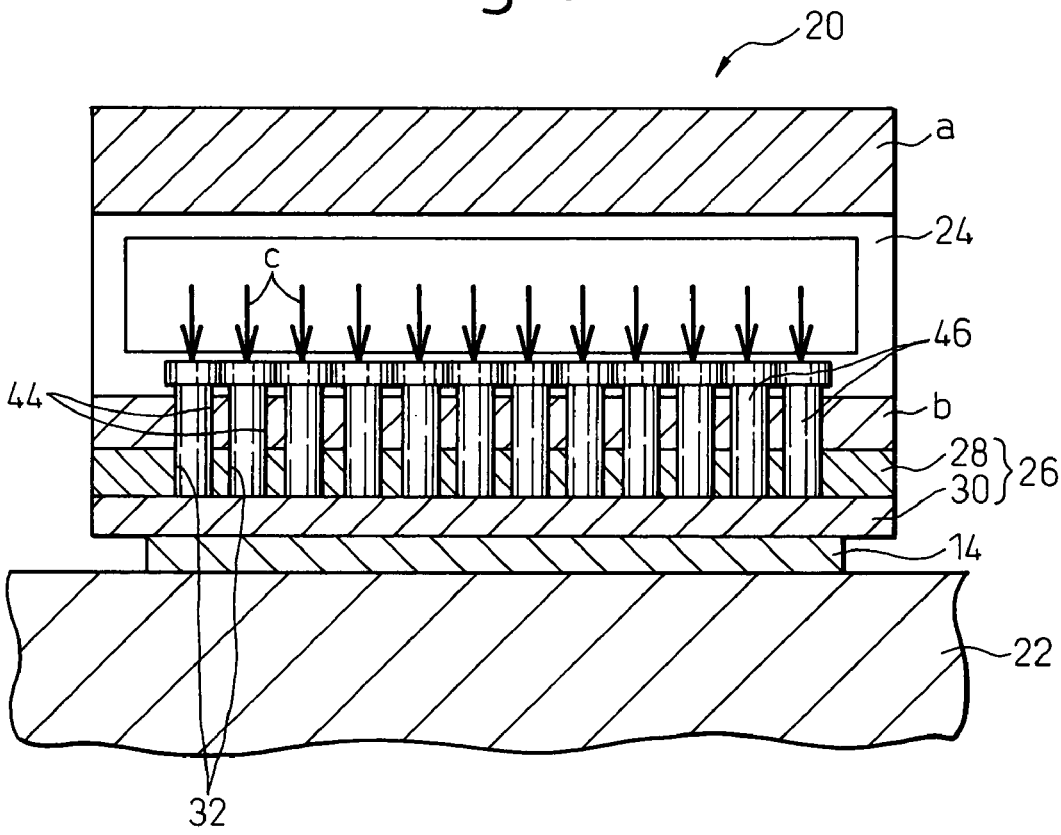
FIG. 5 is a sectional view illustrating the lapping surface plate, the housing and the jig of the polishing apparatus on an enlarged scale.

FIG. 5 is a sectional view illustrating the lapping surface plate 22, the housing 24 and the jig 26 of the polishing apparatus 20, on an enlarged scale. The row bar 14 is held by the jig 26 and is pressed to the lapping surface plate 22 by the action of the air cylinder 42.

The housing 24 has a plurality of pin insertion holes 44 in alignment with the plurality of pin insertion holes 32 of the rigid member 28, the pin insertion holes 44 of the housing 24 being communicated with the pin holes 32 of the rigid member 28, respectively.

A plurality of pins 46 are arranged corresponded to a plurality of aligned pin insertion holes 32 and 44. Each pin 46 is inserted in a set of aligned pin insertion holes 32 and 44. The pins 46 individually receive the pressing force, as indicated by the arrows C, and individually press the portions of the elastic member 30 corresponding to the magnetic head sliders 12 of the row bar 14 through the pin insertion holes 44 in the housing 24 and the pin insertion holes 32 in the rigid member 28. Therefore, each pin 46 applies a pressing force to each point of the elastic member 30 corresponding to each magnetic head slider 12 of the row bar 14. In general, the polishing rate varies in proportion to the lapping pressure and, hence, a point of the row bar 14 that is pressed is locally polished with an increased rate. The pins 46 selectively and separately press the portions of the elastic member 30 corresponding to the magnetic head sliders 12 of the row bar 14 through the pin insertion holes 32 in the rigid member 28.

Figure 6:
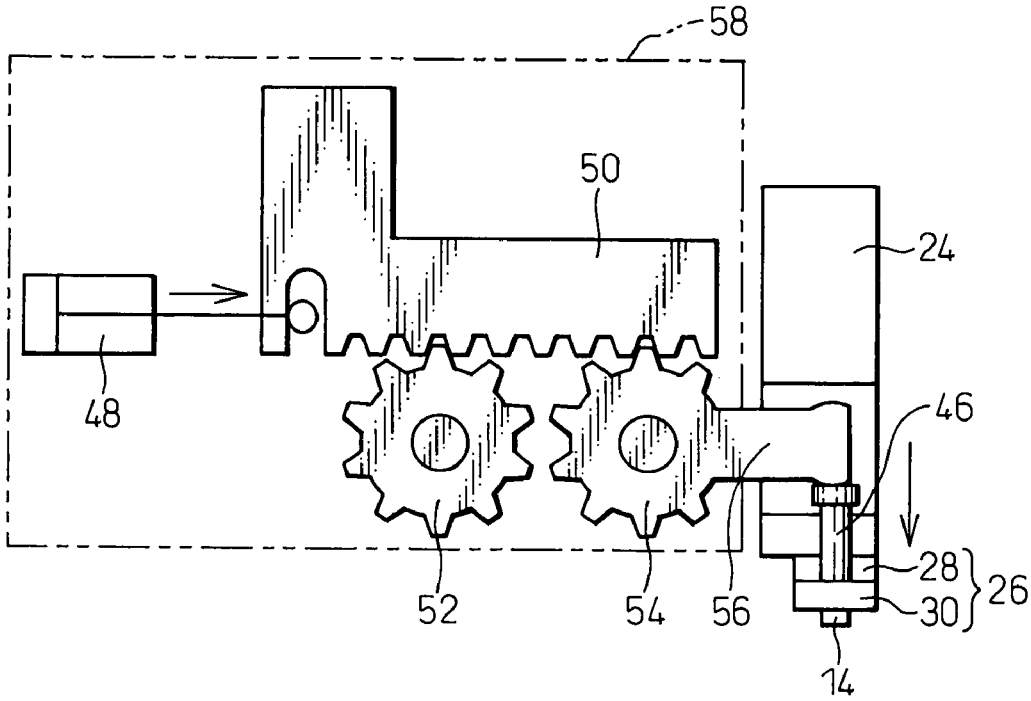
FIG. 6 is a view illustrating a drive mechanism for applying a force to a pin to move the pin.

FIG. 6 is a view illustrating a drive mechanism for moving the pin 46. A plurality of drive mechanisms are provided in parallel in the number same as the number of the pins 46 in FIG. 5. For example, there are provided 28 pins 46, and related drive mechanisms, in parallel, the drive mechanisms being capable of controlling the pressing force for the related pins 46 independently from each other.

The drive mechanism comprises an air cylinder 48, a rack 50, pinions 52 and 54, and a lever 56 provided integrally with the pinion 54. As the piston pin of the air cylinder 48 extends, the rack 50 advances, whereby the pinion 54 and the lever 56 rotate, and the lever 56 pushes the pin 46 down. The pinion 52 turns to support the rack 50. The pin 46 is pushed down to press the elastic member 30 of the jig 26.

Therefore, the pin 46 presses the portion of the elastic member 30 corresponding to the magnetic head slider 12 of the row bar 14. By utilizing this principle, even a slight bending of the row bar 14 can be corrected. The air cylinder 48 may be of the single-acting type working in the pushing direction only. A plurality of air cylinders 48, the racks 50, and pinions 52 and 54 are arranged in a unit casing 58 that support and guide them. The housing 24 is disposed neighboring the unit casing 58. The air cylinder 42 for pressing the row bar 14 as a whole and the air cylinders 48 for pressing respective magnetic head sliders 12 of the row bar 14, are connected to a source of compressed air through tubes or pipes. An electric-pneumatic pressure conversion regulator is arranged in the tube or the pipe, and is controlled by a control unit.

In this embodiment, the drive mechanism is constituted by the air cylinder, the rack and the pinion mechanism and the lever. The drive mechanism, however, may be constituted by using any other actuator and any other link mechanism. The jig 26 and the housing 24 are each secured by using two screws. Instead of using the screws, however, they may be secured relying upon a mechanical locking system or a vacuum adsorption system.

Figure 8:
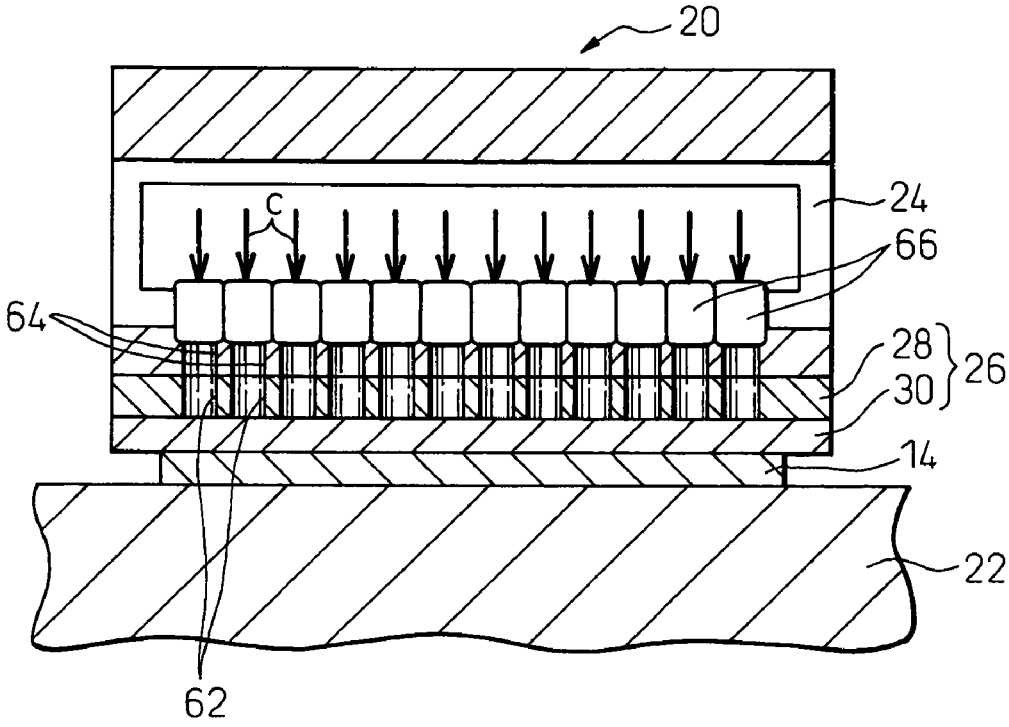
FIG. 8 is a sectional view illustrating the lapping surface plate, the housing and the jig of the polishing apparatus according to another embodiment.
Figure 9:
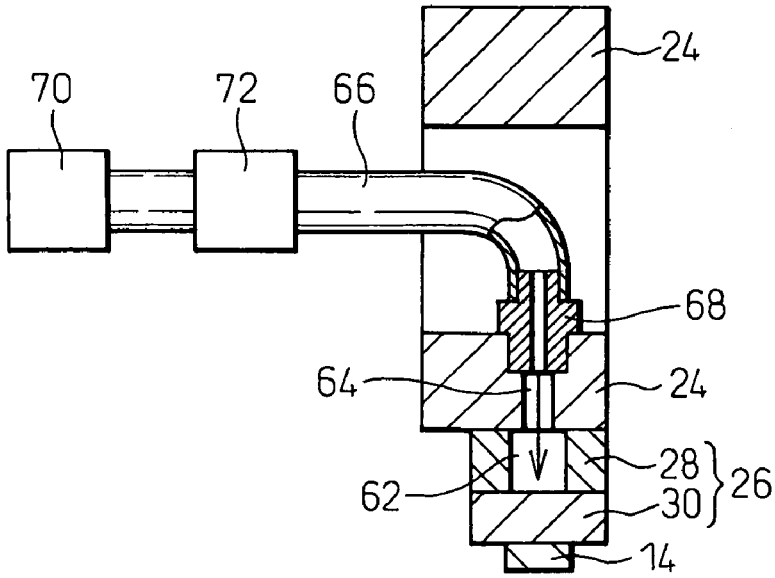
FIG. 9 is a view illustrating the holder, the jig and the air tube of FIG. 8.
Figure 11:
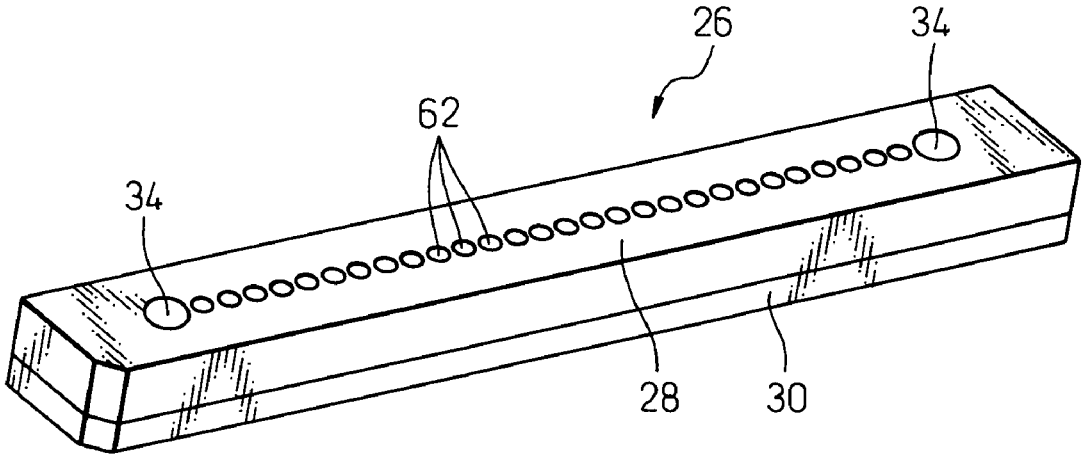
FIG. 11 is a perspective view illustrating a jig comprising a rigid member and an elastic member.

FIG. 8 is a sectional view illustrating the lapping surface plate 22, the housing 24 and the jig 26 of the polishing apparatus 20, according to another embodiment. FIG. 9 is a view illustrating the housing 24, the jig 26 and the air tube of FIG. 8. The polishing apparatus 20 of the embodiment of FIGS. 8 and 9 has the lapping surface plate 22, the housing 24 and the jig 26 like the polishing apparatus 20 of FIG. 5. The jig 26 comprises an elongated and straight plate-like rigid member (stainless steel) 28 and an elongated and straight plate-like elastic member (anti-static rubber) 30 having a contour substantially the same as that of the rigid member 28 and is fixed to the rigid member 28 (FIG. 11). The elastic member 30 is produced by a rubber lining manufacturing and joined to the rigid member 28. The elastic member 30 is joined to the rigid member 28 with an adhesive.

The polishing apparatus 20 of the embodiment of FIG. 5 uses the pins 46 and the drive mechanisms therefor, whereas the polishing apparatus 20 of the embodiment of FIG. 8 is of a static pressure type which directly presses the elastic member 30 with the compressed air, without using the pins 46. Namely, the rigid member 28 has a series of air feeding holes (through holes) 62 corresponding to a plurality of magnetic head sliders 12 provided in the row bar 14, but the elastic member 30 does not have such holes. The rigid member 28 has jig securing threaded holes 34 on the outer sides of a series of the air feed holes 62 (FIG. 11). By driving screws into the jig securing threaded holes 34 through corresponding hole provided in the housing 24, therefore, the jig 26 can be easily and reliably secured to the housing 24. The air feed holes 62 are formed corresponded to the slider pitch in the row bar 14, and its width should be smaller than the slider pitch.

The housing 24 has a plurality of air feed holes 64 in alignment with the plurality of air feed holes 62 in the rigid member 28, the air feed holes 64 in the housing 24 being communicated with the air feed holes 62 in the rigid member 28, respectively.

Air tube 66 is connected to the air feed hole 64 in the housing 24 through a coupling 68. The air tube 66 is connected to the source 70 of compressed air, and an electric-pneumatic pressure conversion regulator (control valve) 72 is arranged in the air tube 66. The air tube 66 feeds the compressed air into the air feed hole 62 in the rigid member 28 through the air feed hole 64 in the housing 24. The air tubes 66 are in a number same as the number of the magnetic head sliders 12 in the row bar 14, and are connected to the air feed holes 62 in the rigid member 28.

The compressed air fed into the air feed holes 62 in the rigid member 28 through the air tubes 66 and the air feed holes 64 in the housing 24, works to individually press the portions of the elastic member 30 corresponding to the magnetic head sliders 12 of the row bar 14. Therefore, the operation of the embodiment of FIGS. 8 and 9 is the same as the operation of the embodiment of FIG. 5.

The air tubes 66 are very fine tubes having an outer diameter of, for example, 1.3 mm. The air feed holes 64 in the housing 24 and the air feed holes 62 in the rigid member 28 are round holes of a diameter of 1 mm. The air feed holes 62 may assume any other shape in cross section.

Figures 10A, 10B, 10C:
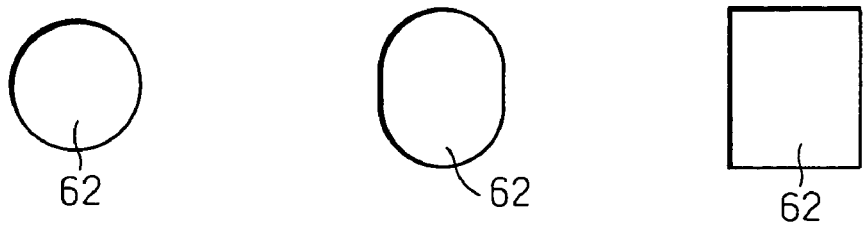
FIGS. 10A to 10C are views illustrating air feed holes of FIGS. 8 and 9.

FIGS. 10A to 10C are views illustrating air feed holes 62 in the rigid member 28 of the jig 26 of FIGS. 8 and 9. FIG. 10A illustrates a round air feed hole 62 of a diameter of 1 mm, FIG. 10B illustrates an air feed hole 62 of an elliptic shape measuring 1 mm×1.2 mm, and FIG. 10C illustrates a rectangular air feed hole 62 measuring 1 mm×1.2 mm.

When the compressed air is fed through the air tube 66, pressure is applied to the air feed hole 62 in the rigid member 28. Where the thrust exerted on the elastic member 30 is denoted by F, the sectional area of the air feed hole 62 by S, and the pressure of the compressed air by P, there is a relationship $F=S\times P$. Here, the pressure P of the compressed air is presumed to be 0.5 MPa. When the air feed hole 62 in the rigid member 28 is a round hole having a diameter of 1 mm, the thrust F is 39.25 gf. In the case of an elliptic hole of 1 mm×1.2 mm, the thrust F becomes 49.25 gf. In the case of a rectangular hole C measuring 1 mm×1.2 mm, a thrust F of 60.25 gf is obtained.

On the other hand, the machining pressure during the practical lapping operation is not larger than 1 Kgf per a row bar 14, from past experience. If each row bar 14 contains 30 magnetic head slides 12, the force applied to each magnetic head slider 12 can be simply calculated to be 1 Kgf/30=33 gf, which is smaller than the thrust F= 39.25 gf produced by the round hole. Therefore, the bending of the magnetic head slider 14 can be corrected by the compressed air to a sufficient degree.

The coupling 68 is of a special shape having a portion onto which the air tube 66 of an outer diameter of 1.3 is fitted, a portion of an expanded diameter that comes in contact with the surface of the housing 24, and a portion which is fitted into the air feed hole 64 of a diameter of 1 mm of the housing 24. By using such a coupling 68, it is possible to adapt for the size of the air feed holes 62 and 64 and to prevent the leakage of air between the air tube 66 and the housing 24. The lower surface of the housing 24 and the upper surface of the rigid member 28 are flattened; i.e., the lower surface of the housing 24 is intimately contacted to the upper surface of the rigid member 28 to constitute a mechanical sealing preventing the leakage of air between the housing 24 and the rigid member 28. As the air feed holes 62 in the rigid member 28 are straight holes, the air feed holes 62 are not clogged when the rigid member 28 is to be lined with the elastic member 30, by providing a masking in the air feed hole 62, and by removing the masking after the lining.

Figure 12:
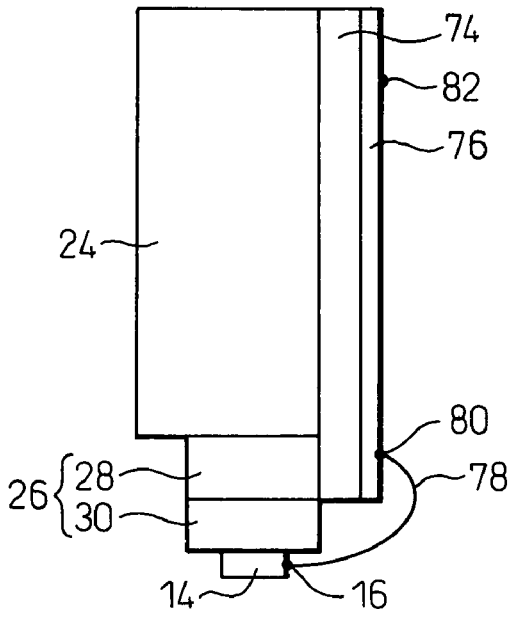
FIG. 12 is a view illustrating an embodiment for measuring the resistance in the inprocess condition.

FIG. 12 is a view illustrating an embodiment of measuring the resistance in the inprocess condition. A support plate 74 is attached to the housing 24 of the polishing apparatus 20, and a relay board (printed board) 76 is attached to the support plate 74. As described earlier, the row bar 14 has two terminals of the ELG resistance element 16 at the boundary between the two magnetic head sliders 12. The ELG resistance element 16 is connected to the terminals 80 of the relay board 76 through bonding wires 78. Many ELG resistance elements 16 are provided, and it is desired that the bonding wires 78 of the same number as the number of the terminals of the ELG resistance elements 16 are connected.

The relay board 76 has probing terminals 82. A probe (not shown) of the resistance measuring means is brought into contact with the probing terminals 82 to measure the resistance in the inprocess condition.

Figure 13:
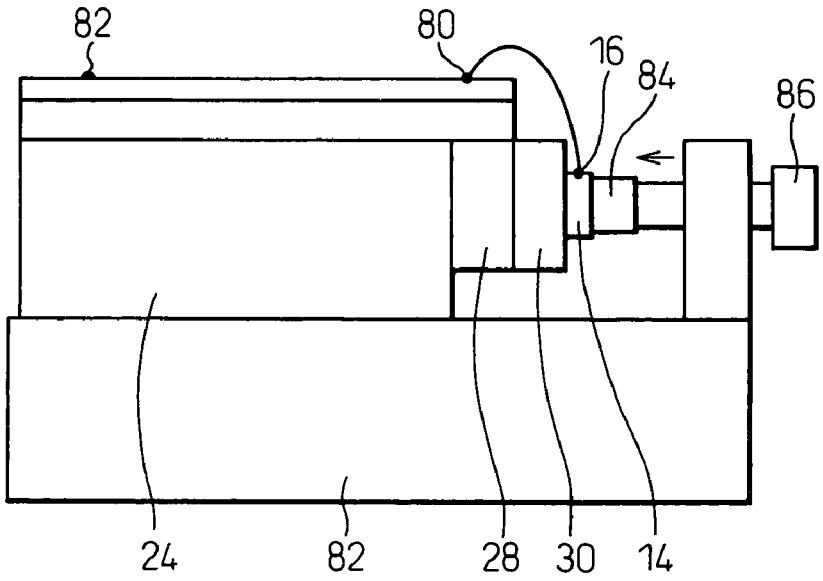
FIG. 13 is a view illustrating an example of effecting the wire bonding regarding the embodiment of FIG. 12.

FIG. 13 is a view illustrating how to bond the wires in the embodiment of FIG. 12. The jig 26, the housing 24 and the relay board 76 are assembled together and the assembly is set onto a base 82 for wire bonding. This is effected by a vacuum attraction method. Then, a holding plate 84 is brought into contact with the row bar 14 and is secured by screws 86 while the row bar 14 is pressed against the elastic member 30. Then, the wire bonding is carried out by a wire bonding machine.

As the row bar 14 is held by the jig 26 relying simply upon the sticking force of the rubber constituting the elastic member 30, and it is probable that the row bar 14 may be peeled off the elastic member 30 at the time of bonding the wires, it is recommended that the row bar 14 is pressed against the elastic member 30 in this manner. Besides, as the row bar 14 is in contact with the rubber that constitutes the elastic member 30, and ultrasonic oscillation for effecting the wire bonding is absorbed by the rubber, so it is difficult to properly execute the wire bonding. Upon employing the constitution illustrated in FIG. 13, however, the ultrasonic wave oscillation absorption action of the rubber is decreased, and the wire bonding can be properly effected. Therefore, the operation for polishing the row bar 14 is conducted while measuring the resistance as illustrated in FIG. 12 in the inprocess condition.

What is claimed is:

1. An apparatus for polishing a row bar including a plurality of magnetic head sliders, said apparatus comprising:

a rotatable lapping surface plate;

a movable housing above said lapping surface plate;

a jig secured to said housing and comprising a rigid member having a plurality of holes and an elastic member fixed to said rigid member for holding a row bar;

first pressing means for applying a pressure to the whole row bar; and second pressing means for individually pressing portions of the elastic member corresponding to a plurality of magnetic head sliders of the row bar through said holes of the rigid member.

2. A polishing apparatus according to claim 1, wherein said housing reciprocally moves in the radial direction of the lapping surface plate.

3. A polishing apparatus according to claim 1, wherein the elastic member of said jig is adhered to the rigid member.

4. A polishing apparatus according to claim 1, wherein said jig is secured to said housing by screws.

5. A polishing apparatus according to claim 1, further comprising control means for controlling said second pressing means depending upon a change in the resistance of resistance elements provided in said row bar.

6. A polishing apparatus according to claim 1, wherein said second pressing means comprises pins inserted in the holes of said rigid member and drive mechanisms for driving said pins.

7. A polishing apparatus according to claim 6, wherein said drive mechanism includes an air cylinder and a transmission mechanism for transmitting the action of the air cylinder to the pin.

8. A polishing apparatus according to claim 1, wherein said second pressing means comprises compressed air feeding means for introducing the compressed air into the holes of said rigid member.

9. A polishing apparatus according to claim 8, wherein said compressed air feeding means comprises a conduit connected to a source of compressed air and a control valve arranged in said conduit.

10. A polishing apparatus according to claim 9, wherein said housing has a plurality of holes in alignment with a plurality of holes of said rigid member, said holes of said housing being communicated with said holes of said rigid member.

11. A polishing apparatus according to claim 10, wherein said conduit is connected to each hole of said housing.

12. A method of polishing a row bar including a plurality of magnetic head sliders, said method comprising the steps of:

securing a jig to a movable housing, said jig including a rigid member having a plurality of holes and an elastic member fixed to said rigid member;

holding a row bar by said jig;

moving said housing above a lapping surface plate;

turning said lapping surface plate to polish said row bar while pressing the row bar onto said lapping surface plate;

measuring a change in the resistance of resistance elements provided in the row bar; and individually pressing portions of the elastic member corresponding to a plurality of magnetic head sliders of the row bar through said holes of said rigid member in response to a change in the resistance of the resistance elements provided in said row bar.

13. A method of polishing a row bar according to claim 12, wherein resistance elements provided in the row bar are connected to a relay board, and a change in the resistance of the resistance elements provided in the row bar is measured on the relay board.

14. A method of polishing a row bar according to claim 13, wherein the resistance elements provided in the row bar are connected to the relay board through bonding wires.

15. A method of polishing a row bar according to claim 14, wherein the bonding wires are bonded while holding the row bar between the jig and a holding plate.

16. A method of polishing a row bar according to claim 12, wherein the portions of the elastic member are pressed by pins inserted in the holes of said rigid member.

17. A method of polishing a row bar according to claim 12, wherein the portions of the elastic members are pressed by compressed air introduced into the holes of said rigid member.

* * * * *